US011268712B2

(12) United States Patent
Heigl

(10) Patent No.: US 11,268,712 B2
(45) Date of Patent: Mar. 8, 2022

(54) FORCED AIR CONDITIONING SYSTEM

(71) Applicant: CARRIER CORPORATION, Palm Beach Gardens, FL (US)

(72) Inventor: Keith David Heigl, Winamac, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 623 days.

(21) Appl. No.: 16/185,974

(22) Filed: Nov. 9, 2018

(65) Prior Publication Data

US 2019/0145642 A1 May 16, 2019

Related U.S. Application Data

(60) Provisional application No. 62/584,317, filed on Nov. 10, 2017.

(51) Int. Cl.

| | |
|---|---|
| ***F24F 11/00*** | (2018.01) |
| ***F24F 13/10*** | (2006.01) |
| ***F24F 11/74*** | (2018.01) |
| ***F24F 11/30*** | (2018.01) |
| ***F24F 11/64*** | (2018.01) |
| ***F24F 110/20*** | (2018.01) |
| ***F24F 110/10*** | (2018.01) |
| ***F24F 11/58*** | (2018.01) |

(52) U.S. Cl.

CPC ..... *F24F 11/0001* (2013.01); *F24F 11/30* (2018.01); *F24F 11/64* (2018.01); *F24F 11/74* (2018.01); *F24F 13/10* (2013.01); *F24F 11/58* (2018.01); *F24F 2110/10* (2018.01); *F24F 2110/20* (2018.01); *F24F 2221/34* (2013.01)

(58) Field of Classification Search

CPC ..... F24F 11/0001; F24F 11/74; F24F 11/64; F24F 11/58; F24F 11/30; F24F 13/10; F24F 2110/20; F24F 2110/10; F24F 221/34

USPC ..... 454/239

See application file for complete search history.

(56) References Cited

U.S. PATENT DOCUMENTS

| | | | |
|---|---|---|---|
| 4,203,485 | A | 5/1980 | Zilbermann et al. |
| 4,495,986 | A | 1/1985 | Clark et al. |

(Continued)

FOREIGN PATENT DOCUMENTS

| | | | |
|---|---|---|---|
| CN | 1191292 | A | 8/1998 |
| CN | 1959260 | A | 5/2007 |

(Continued)

*Primary Examiner* — Vivek K Shirsat

(74) *Attorney, Agent, or Firm* — Cantor Colburn LLP

(57) ABSTRACT

A forced air conditioning system includes supply and return air plenum, an air treatment device, first and second air return dampers, first and second sensors, and a controller. The plenums communicate with first and second rooms and the treatment device is adapted to condition air when activated and not condition air when deactivated. The air return dampers are adapted to isolate the respective first and second rooms when closed. The sensors are located in the respective first and second rooms and are configured to detect a condition of the air. The controller is configured to receive condition signals from the respective sensors, compare the signals to a preprogrammed air condition threshold, and output a command signal to close one of the dampers to substantially equalize the air condition between rooms when the preprogrammed air condition threshold is met, and the air treatment device is deactivated.

18 Claims, 2 Drawing Sheets

(56) References Cited

U.S. PATENT DOCUMENTS

| | | | | | |
|---|---|---|---|---|---|
| 4,630,670 | A * | 12/1986 | Wellman | F24F 3/0442 165/216 |
| 4,716,957 | A | 1/1988 | Thompson et al. | |
| 4,824,012 | A | 4/1989 | Tate | |
| 5,103,896 | A | 4/1992 | Saga | |
| 5,161,608 | A | 11/1992 | Osheroff | |
| 5,341,988 | A | 8/1994 | Rein et al. | |
| 5,394,324 | A | 2/1995 | Clearwater | |
| 5,495,887 | A | 3/1996 | Kathnelson et al. | |
| 5,720,658 | A * | 2/1998 | Belusa | F24F 11/70 454/238 |
| 2004/0182941 | A1 | 9/2004 | Alles | |
| 2009/0065595 | A1 | 3/2009 | Kates | |
| 2009/0255997 | A1 | 10/2009 | Goldmann et al. | |
| 2011/0198404 | A1 | 8/2011 | Dropmann | |
| 2011/0269389 | A1 | 11/2011 | Scharf et al. | |
| 2011/0300790 | A1* | 12/2011 | Bauer | F24F 11/70 454/239 |
| 2012/0238199 | A1 | 9/2012 | Kim | |
| 2013/0056177 | A1 | 3/2013 | Coutu et al. | |
| 2013/0204442 | A1 | 8/2013 | Modi et al. | |
| 2015/0370927 | A1 | 12/2015 | Flaherty et al. | |
| 2016/0320078 | A1 | 11/2016 | Milder et al. | |
| 2019/0086116 | A1* | 3/2019 | Buchanan | F24F 7/08 |

FOREIGN PATENT DOCUMENTS

| | | | | |
|---|---|---|---|---|
| CN | 103322629 | A | 9/2013 | |
| EP | 1538399 | A2 * | 6/2005 | F24F 11/0001 |
| EP | 2660526 | A2 | 11/2013 | |
| GB | 450538 | A | 7/1936 | |
| KR | 20050075144 | A | 7/2005 | |

* cited by examiner

FORCED AIR CONDITIONING SYSTEM

CROSS-REFERENCE TO RELATED APPLICATIONS

This application claims the benefit of priority to U.S. Provisional Application No. 62/584,317, filed Nov. 10, 2017, which is incorporated herein by reference in its entirety.

BACKGROUND

The present disclosure relates to a forced air conditioning system, and more particularly, to a forced air conditioning system with a recirculation mode for conserving energy.

Forced air conditioning systems are constructed to condition (e.g., heat) air located in multiple regions or rooms of a single dwelling or structure. The air may be conditioned by, for example, a gas heater, and is then caused to flow through a configuration of ducts by a blower to the various room. Unfortunately, various rooms may require different amounts of air conditioning or heat for any given moment in time. This disparity may cause human discomfort between rooms, and/or may cause the gas heater to run excessively consuming additional energy.

BRIEF DESCRIPTION

A forced air conditioning system adapted to treat air temperature in at least first and second rooms of a dwelling according to one, non-limiting, embodiment of the present disclosure includes a supply air plenum in fluid communication with the first and second rooms; a return air plenum in fluid communication with the first and second rooms; an air treatment device adapted to condition air flowing from the return air plenum and into the supply air plenum when in an activated state and not condition the air when in a deactivated state; a first air return damper adapted to isolate the first room from the return air plenum when in a closed position and permit airflow from the first room and into the return air plenum when in an open position; a second air return damper adapted to isolate the second room from the return air plenum when in a closed position and permit airflow from the second room and into the return air plenum when in an open position; a first sensor disposed in the first room for detecting a condition of the air in the first room; a second sensor disposed in the second room for detecting the condition of the air in the second room; and a controller configured to receive first and second air condition signals from the respective first and second sensors, compare the first and second air condition signals to a preprogrammed air condition threshold, and output a position command signal to close one of the first and second air return dampers to substantially equalize the air condition in the first room to the air condition in the second room when the preprogrammed air condition threshold is met, and when the air treatment device is in the deactivated state.

Additionally to the foregoing embodiment, the forced air conditioning system includes a first blower adapted to induce airflow in the supply and return air plenums, wherein the blower is configured to receive a flow activate command from the controller when the air treatment device is in the deactivated state and the preprogrammed air condition threshold is met for inducing airflow through the supply and return air plenums.

In the alternative or additionally thereto, in the foregoing embodiment, the forced air conditioning system includes an air condition unit, wherein the first blower and the air treatment device are part of the air condition unit, and are adapted to receive a normal run command when the air condition unit is in the activated state for inducing airflow through the supply and return air plenums.

In the alternative or additionally thereto, in the foregoing embodiment, the forced air conditioning system includes an air condition unit, wherein the air condition unit includes the air treatment device and a second blower configured to induce airflow through the supply and return air plenums when the air condition unit is in the activated state.

In the alternative or additionally thereto, in the foregoing embodiment, conditioning of the air is heating.

In the alternative or additionally thereto, in the foregoing embodiment, the forced air conditioning includes a forced air furnace, wherein the forced air furnace includes the first blower and the air treatment device.

In the alternative or additionally thereto, in the foregoing embodiment, the conditioning of the air is cooling.

In the alternative or additionally thereto, in the foregoing embodiment, the air condition is humidity.

In the alternative or additionally thereto, in the foregoing embodiment, the forced air conditioning system includes a first air supply damper adapted to isolate the first room from the supply air plenum when in a closed position and permit airflow from the supply air plenum and into the first room when in an open position; and a second air supply damper adapted to isolate the second room from the supply air plenum when in a closed position and permit airflow from the supply air plenum and into the second room when in an open position, wherein the controller is configured to output a supply position command signal to close one of the first and second air supply dampers to substantially equalize the air condition in the first room to the air condition in the second room when the preprogrammed air condition threshold is met, and when the air treatment device is in the deactivated state.

In the alternative or additionally thereto, in the foregoing embodiment, the first and second air return dampers include a baffle adapted to block airflow and an electric motor configured to move the baffle between the open and closed positions.

In the alternative or additionally thereto, in the foregoing embodiment, the forced air conditioning system includes a thermostat disposed in the dwelling and configured to output a condition signal associated with placing the air treatment device in the activated and deactivated states.

A forced air conditioning system adapted to treat air temperature in at least first, second and third rooms of a dwelling according to another, non-limiting, embodiment includes a supply air plenum in fluid communication with the first, second, and third rooms; a return air plenum in fluid communication with the first, second, and third rooms; a forced air furnace including a heater and a blower, wherein the heater is controllably adapted to heat the airflow when in an activated state, and the blower is adapted to induce airflow from the return air plenum and into the supply air plenum when the heater is in the activated state and when in a deactivated state; a thermostat configured to measure air temperature in the dwelling, compare the air temperature to a preprogrammed temperature setpoint and output an activate command signal to the forced air furnace when air temperature falls below the temperature setpoint to place the forced air furnace in the activated state; first, second, and third air dampers each adapted to at least partially isolate the respective first, second, and third rooms from one of the return and supply air plenums; first, second, and third temperature sensors each configured to measure air temperature in the respective first, second, and third rooms; and a controller configured to receive first, second, and third temperature signals from the respective first, second, and third temperature sensors, compare the first, second, and third temperature signals to a preprogrammed temperature threshold, and output at least one position command signal to at least one of the first, second, and third air dampers to recirculate air from the hotter of the first, second, and third rooms to the cooler of the first, second, and third rooms.

Additionally to the foregoing embodiment, the blower is configured to operate in a primary mode when the heater is in the activated state and in a recirculation mode when the heater is in the deactivated state.

In the alternative or additionally thereto, in the foregoing embodiment, the controller is configured to send a recirculation command to the blower placing the blower in the recirculation mode when the preprogrammed temperature threshold is exceeded.

In the alternative or additionally thereto, in the foregoing embodiment, the first, second, and third air dampers are air return dampers adapted to isolate the return air plenum from the respective first, second, and third rooms.

In the alternative or additionally thereto, in the foregoing embodiment, the first, second, and third air return dampers are in a closed position if the air in the associated first, second, and third rooms exceed the preprogrammed temperature threshold, and are is an open position if the air in the associated first, second, and third rooms does not exceed the preprogrammed temperature threshold.

In the alternative or additionally thereto, in the foregoing embodiment, the forced air conditioning system includes first, second, and third air supply dampers adapted to isolate the respective first, second, and third rooms from the supply air plenum, wherein the first, second, and third air supply dampers are in an open position if the air in the associated first, second, and third rooms exceed the preprogrammed temperature threshold, and at least one of the first, second, and third air supply dampers are in a closed position if the air in the associated first, second, and third rooms does not exceed the preprogrammed temperature threshold and when the heater is in the deactivated state.

In the alternative or additionally thereto, in the foregoing embodiment, the preprogrammed temperature threshold may be an upper temperature threshold, and the controller further includes a preprogrammed lower temperature threshold, and wherein the first air supply damper is in the closed position, the second air supply damper is in the open position, the third air supply damper is in the closed position, the first air return damper is in the open position, the second air return damper is in the closed position, and the third air damper is in the closed position when the air temperature in the first room exceeds the upper temperature threshold, the air temperature in the second room is below the lower temperature threshold, and the air temperature in the third room is between the upper and lower temperature thresholds.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
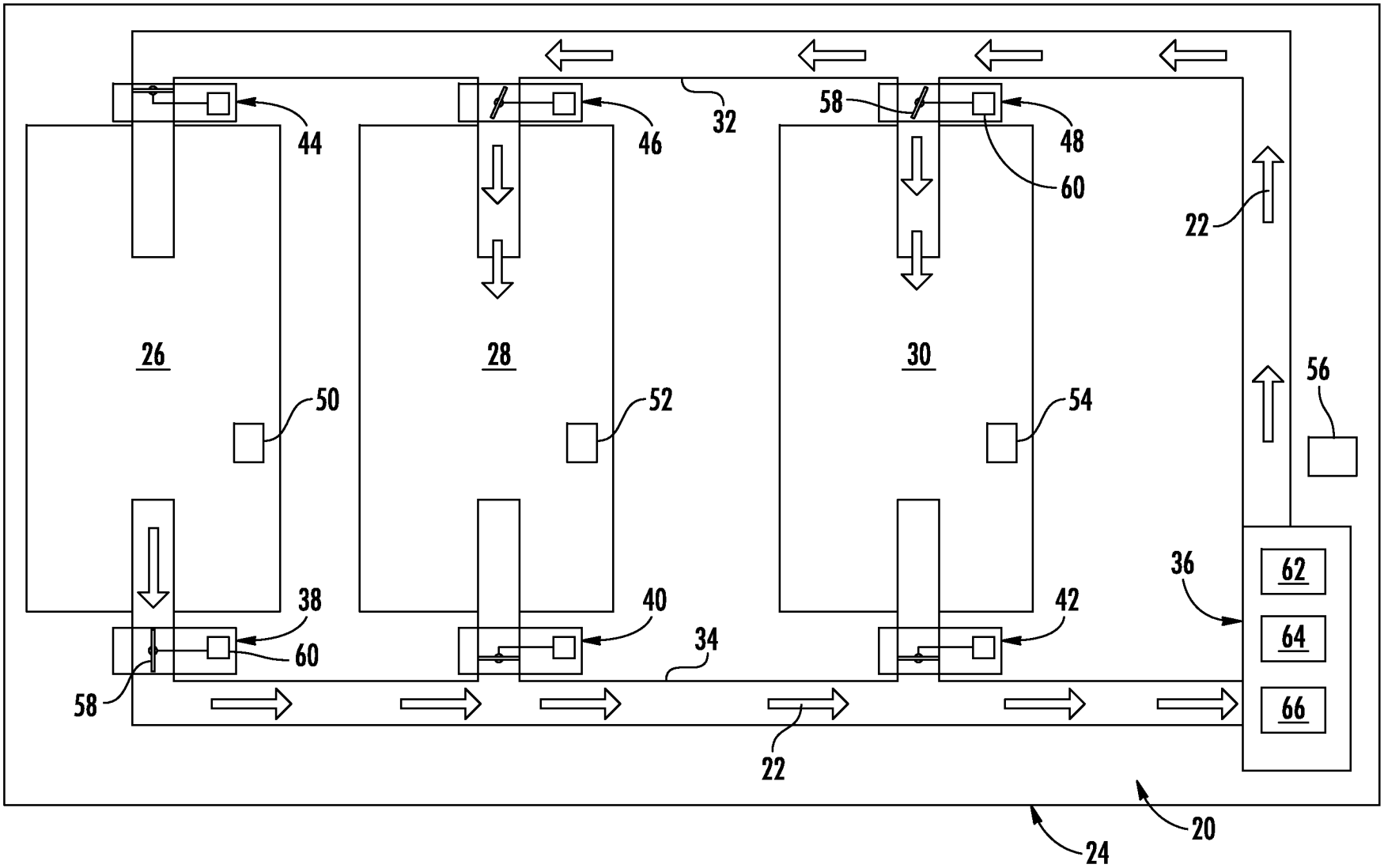
FIG. 1 is a schematic of a schematic of a dwelling utilizing a forced air conditioning system of the present disclosure, and in accordance with one, non-limiting, exemplary embodiment.

Referring to FIG. 1, a forced air conditioning system 20 may be located, and constructed to condition air (see arrows 22), in a dwelling 24 having a plurality of regions or rooms (i.e., three illustrated as 26, 28, 30). The conditioning of the air 22 may be a process that heats, cools, and/or controls humidity levels of the air 22. The forced air conditioning system 20 is configured to operate in a normal activated state that conditions air in the dwelling 24, and in a deactivated, or recirculation state that does not facilitate actual conditioning of the air. When in the deactivated state, the forced air conditioning system 20 does facilitate the redistribution of the air between the rooms 26, 28, 30 for occupant comfort and energy efficiency or savings. For example, if air in room 26 is overly conditioned, and the air in room 28 is under-conditioned, the air conditioning system 20 facilitates redistribution of air from the first room 26 and into the second room 28.

The forced air conditioning system 20 may include a supply air plenum 32, a return air plenum 34, an air condition unit 36, a first air return damper 38, a second air return damper 40, a third air return damper 42, a first air supply damper 44, a second air supply damper 46, a third air supply damper 48, a first air condition sensor 50, a second air condition sensor 52, a third air condition sensor 54, and a primary air condition sensor assembly 56 (e.g., thermostat). Each air damper 38, 40, 42, 44, 46, 48 may include a baffle 58 adapted to move between open and closed positions, and a drive device or electric motor 60 configured to move the baffle 58. When the baffle 58 is in the closed position, direct fluid communication between the associated room 26, 28, 30 and the associated air plenum 32, 34 is isolated or substantially blocked. When the baffle 58 is in the open position, flow of the air 22 is permitted (i.e., generally not restricted) between the associated room 26, 28, 30 and the associated air plenum 30, 32.

The air condition unit 36 of the forced air conditioning system 20 is generally located between the supply and return air plenums 32, 34, and thus receives flow of the air 22 from the return air plenum 34, treats the air relative to a particular condition, and then expels the air into the supply air plenum 32. The air condition unit 36 may include a controller 62, an air treatment device 64, and a blower 66 (i.e., fan). When the air conditioning system 20 is in the activated state, the air treatment device 64 may be energized to facilitate the conditioning of the air 22. When the air conditioning system 20 is in the deactivated state, the air treatment device 64 is de-energized (i.e., idle), however the blower 66 may be energized to recirculate the air 22. In one embodiment, the blower 66 may be a variable speed blower that may operate in a high speed mode when the air conditioning system 20 is in the activated state, and a low speed mode when the air conditioning system 20 is in the deactivated state. As will become apparent, the blower may run continuously in the low speed mode when the system 20 is in the deactivated state, or may run intermittently as commanded by the controller 62.

Figure 2:
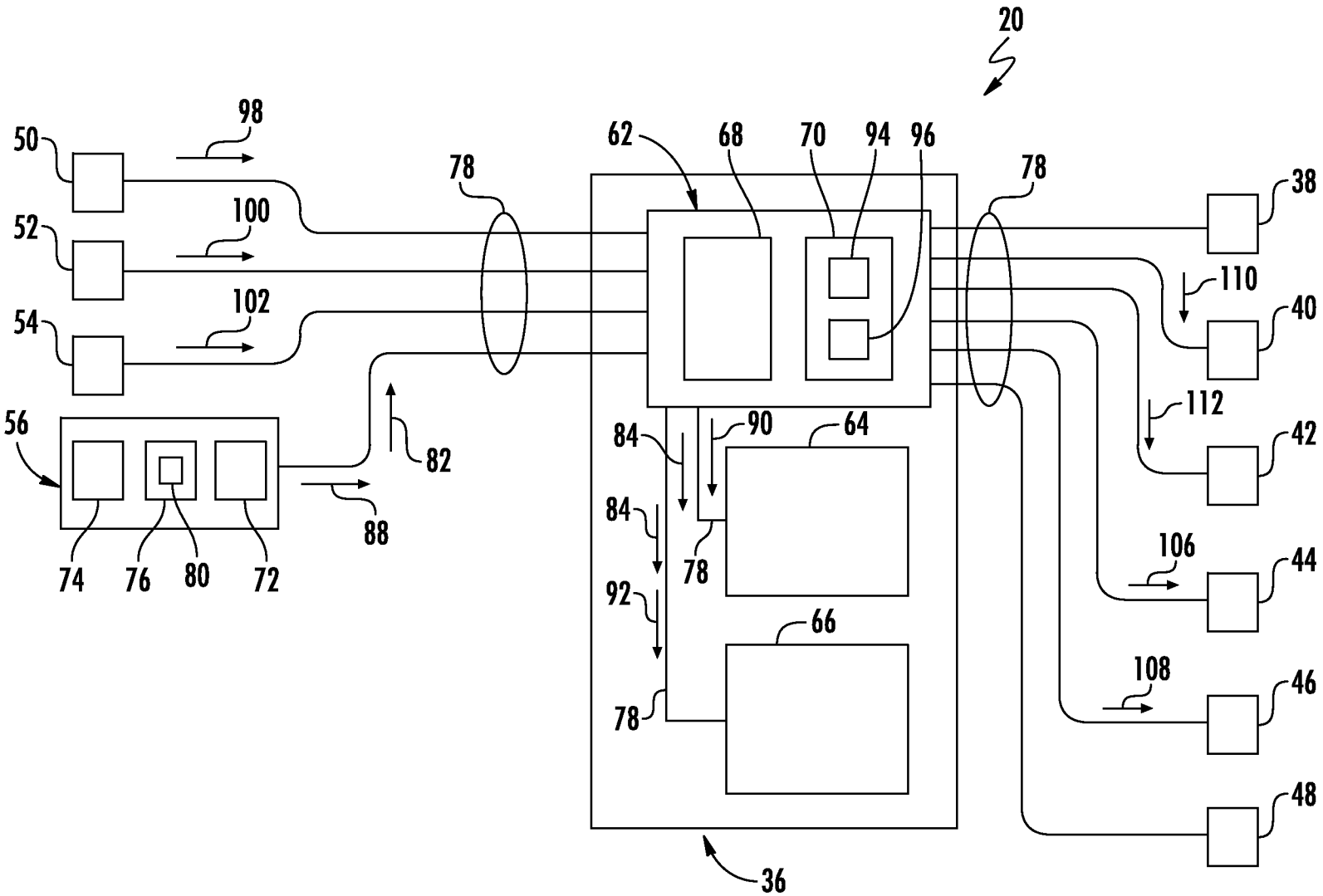
FIG. 2 is a schematic of the forced air conditioning system.

Referring to FIGS. 1 and 2, the controller 62 of the air condition unit 36 may include a processor 68 (e.g., microprocessor) and an electronic storage medium 70 that may be computer writable and readable. In one embodiment, the controller 62 is local to the treatment device 32. Similarly, the primary air condition sensor assembly 56 may include a condition sensor 72, a processor 74, and an electronic storage medium 76 that may be computer writeable and readable. It is contemplated and understood that the controller 62 of the air condition unit 36 may be part of the sensor assembly 56, or vice-versa. Furthermore the controller 62 may include a plurality of processors that may be remote or local to the air condition unit 36.

In one example, if the condition of the air 22 at issue is temperature, the air treatment device 64 may be a heater used to heat the air 22. In another example, the air treatment device 64 may be a refrigeration or cooling unit used to cool the air. In both examples where the conditioning of the air 22 is associated with temperature, the condition sensors 50, 52, 54 may be temperature sensors (e.g., thermocouples). In yet another example, and if the condition of the air 22 at issue is humidity, the treatment device 64 may be a humidifier or a dehumidifier, and the condition sensors 50, 52, 54 may be humidity sensors (e.g., capacitive relative humidity sensor). In operation, and regardless of what the conditioning of the air 22 may be, the blower 66 is adapted to induce the flow of the air 22 from the return air plenum 34, generally through the air treatment device 64, and into the supply air plenum 32.

In one embodiment, the sensors 50, 52, 54, sensor assembly 56, treatment device 64, blower 66, and dampers 38, 40, 42, 44, 46, 48 may generally communicate with the controller 62 of the air condition unit 36 over pathways 78 that may be hardwired or wireless. For the sake of explanation simplicity, the air conditioning unit 36 example of a furnace is applied to explain the operation of the air conditioning system 22 for both a primary or normal mode of operation, and a recirculation mode of operation that facilities conservation of energy and generally equalizes the air condition (e.g., temperature) between the plurality of rooms 26, 28, 30.

As part of, and during, the primary mode of operation of the air conditioning system 22, the thermostat 56 may be preprogrammed with a temperature setpoint 80 that may be stored in the storage medium 76 of the thermostat 56. When the temperature of the air 22 proximate to the thermostat 56 generally falls below the preprogrammed temperature setpoint 80, the thermostat 56 may send an activate command signal (see arrow 82 in FIG. 2) to the controller 62 of the furnace 36. The controller 62 may then output a command signal (see arrow 84) to the air treatment device 64 (e.g., gas heater), and a command signal (see arrow 86) to the air blower 66, thereby switching the air conditioning unit 36 from a deactivated state and into an activated state.

When the air temperature proximate to the thermostat 56 is restored (is at or exceeds the temperature setpoint 80, the thermostat 56 may send a deactivate command signal (see arrow 88) to the furnace controller 62. The furnace controller 62 may then send associated command signals (see arrows 90, 92) to the respective air treatment device 64 and furnace blower 66, thus switching the air conditioning unit 36 from the activated state and into the deactivated state.

When in the air conditioning unit 36 is in the deactivated state, the air conditioning system 20 is capable of operating in the recirculation mode. As part of the recirculation mode, the furnace controller 62 may be preprogrammed with at least one temperature threshold (i.e., two illustrated as 94, 96). In one embodiment, threshold 94 may be a low temperature threshold, and threshold 96 may be a high temperature threshold. Each temperature sensor 50, 52, 54 may send respective temperature signals (see arrows 98, 100, 102) to the furnace controller 62. Utilizing the temperature signals 98, 100, 102 and thresholds 94, 96, the processor 68 of the controller 62 may, for example, apply a programmed algorithm that generally compares room temperatures, and causes recirculation of hotter air from one room into the room(s) with cooler air.

For example, room 26 may be found, via temperature signal 98 to contain air 22 having a temperature that exceeds an upper temperature threshold 96 (e.g., 78 degrees Fahrenheit). Room 26 may be found, via temperature signal 100, to contain air 22 having a temperature that is greater than a lower temperature threshold 94 (e.g., 68 degrees Fahrenheit) and below the upper temperature threshold 96. Room 28 may be found, via temperature signal 102, to contain air 22 having a temperature that falls below the lower temperature threshold 94. Without activating the air treatment device 64, the furnace controller 62 may be configured to utilize the hot air from room 26 to generally heat the colder air in room 30 via running the blower 66 in the recirculation mode and configuring/operating the dampers 38, 40, 42, 44, 46, 48 accordingly.

More specifically and in the present scenario example, all of the dampers 38, 40, 42, 44, 46, 48 may be normally open (i.e., open when the air conditioning system 20 is in the primary mode and/or the air treatment device is in the activate state). While the air conditioning system is in the recirculation mode, the furnace controller 62 may output a position or close command signal (see arrow 106) to the air supply damper 44, a position or close command signal (see arrow 108) to the air supply damper 46, a position or close command signal (see arrow 110) to the air return damper 40, and a position or close command signal (see arrow 112) to the air return damper 42. With this damper position configuration, room 28 having a temperature that lies within an acceptable range (i.e., between the upper and lower thresholds 94, 96) is isolated, hot air is generally suctioned out of room 26, and is generally flowed (i.e., pushed) into the colder room 30.

In one embodiment, the furnace blower 66 may be a variable speed, or two stage, blower that may operate in a low speed during the recirculation mode and in a high speed during the primary mode (i.e., activated state). In other embodiments, the dampers 38, 40, 42, 44, 46, 48 may not have a normal open position (i.e., biased open), and instead, the damper position commands sent by the furnace controller may include both open and close commands, and may further include partially open and/or partially close commands. In yet other embodiments, the air conditioning system 20 may include a second fan or blower located in the supply or return plenums 32, 34, and dedicated to operate during the recirculation mode only, while the furnace blower 66 is dedicated to operate during the primary mode only.

In further embodiments, a simplified air conditioning system 20 may not include the lower threshold 94, and may not include the air supply dampers 44, 46, 48. Instead, when one room exceeds the upper temperature threshold 96, the associated air return damper is opened and the air return damper of the colder room (the room requiring heat) is closed.

While the present disclosure is described with reference to illustrated embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A forced air conditioning system adapted to treat air temperature in at least first and second rooms of a dwelling, the forced air condition system comprising:

a supply air plenum in fluid communication with the first and second rooms;

a return air plenum in fluid communication with the first and second rooms;

an air treatment device adapted to effectuate at least one of heating, cooling, humidifying and dehumidifying air flowing from the return air plenum and into the supply air plenum when in an activated state and not effectuate the heating, cooling, humidifying and dehumidifying the air when in a deactivated state, wherein a condition of the air consists of at least one of temperature and humidity;

a first air return damper adapted to isolate the first room from the return air plenum when in a closed position and permit airflow from the first room and into the return air plenum when in an open position;

a second air return damper adapted to isolate the second room from the return air plenum when in a closed position and permit airflow from the second room and into the return air plenum when in an open position;

a first sensor disposed in the first room for detecting the condition of the air in the first room;

a second sensor disposed in the second room for detecting the condition of the air in the second room; and a controller configured to receive first and second air condition signals from the respective first and second sensors, compare the first and second air condition signals to a preprogrammed air condition threshold, and output a position command signal to close one of the first and second air return dampers to substantially equalize the air condition in the first room to the air condition in the second room when the preprogrammed air condition threshold is met, and when the air treatment device is in the deactivated state.

2. The forced air conditioning system set forth in claim 1, further comprising:

a first blower adapted to induce airflow in the supply and return air plenums, wherein the blower is configured to receive a flow activate command from the controller when the air treatment device is in the deactivated state and the preprogrammed air condition threshold is met for inducing airflow through the supply and return air plenums.

3. The forced air conditioning system set forth in claim 2, further comprising:

an air condition unit, wherein the first blower and the air treatment device are part of the air condition unit, and are adapted to receive a normal run command when the air condition unit is in the activated state for inducing airflow through the supply and return air plenums.

4. The forced air conditioning system set forth in claim 2, further comprising:

an air condition unit, wherein the air condition unit includes the air treatment device and a second blower configured to induce airflow through the supply and return air plenums when the air condition unit is in the activated state.

5. The forced air conditioning system set forth in claim 2, wherein conditioning of the air is heating.

6. The forced air conditioning system set forth in claim 5, further comprising:

a forced air furnace, wherein the forced air furnace includes the first blower and the air treatment device.

7. The forced air conditioning system set forth in claim 2, wherein the conditioning of the air is cooling.

8. The forced air conditioning system set forth in claim 2, wherein the air condition is humidity.

9. The forced air conditioning system set forth in claim 1, further comprising:

a first air supply damper adapted to isolate the first room from the supply air plenum when in a closed position and permit airflow from the supply air plenum and into the first room when in an open position; and a second air supply damper adapted to isolate the second room from the supply air plenum when in a closed position and permit airflow from the supply air plenum and into the second room when in an open position, wherein the controller is configured to output a supply position command signal to close one of the first and second air supply dampers to substantially equalize the air condition in the first room to the air condition in the second room when the preprogrammed air condition threshold is met, and when the air treatment device is in the deactivated state.

10. The forced air conditioning system set forth in claim 1, wherein the first and second air return dampers include a baffle adapted to block airflow and an electric motor configured to move the baffle between the open and closed positions.

11. The forced air conditioning system set forth in claim 1, further comprising:

a thermostat disposed in the dwelling and configured to output a condition signal associated with placing the air treatment device in the activated and deactivated states.

12. A forced air conditioning system adapted to treat air temperature in at least first, second and third rooms of a dwelling, the forced air condition system comprising:

a supply air plenum in fluid communication with the first, second, and third rooms;

a return air plenum in fluid communication with the first, second, and third rooms;

a forced air furnace including a heater and a blower, wherein the heater is controllably adapted to heat the airflow when in an activated state, and the blower is adapted to induce airflow from the return air plenum and into the supply air plenum when the heater is in the activated state and when in a deactivated state;

a thermostat configured to measure air temperature in the dwelling, compare the air temperature to a preprogrammed temperature setpoint and output an activate command signal to the forced air furnace when air temperature falls below the temperature setpoint to place the forced air furnace in the activated state;

first, second, and third air dampers each adapted to at least partially isolate the respective first, second, and third rooms from one of the return and supply air plenums;

first, second, and third temperature sensors each configured to measure air temperature in the respective first, second, and third rooms; and a controller configured to receive first, second, and third temperature signals from the respective first, second, and third temperature sensors, compare the first, second, and third temperature signals to a preprogrammed temperature threshold, and output at least one position command signal to at least one of the first, second, and third air dampers to recirculate air from the hotter of the first, second, and third rooms to the cooler of the first, second, and third rooms.

13. The forced air conditioning system set forth in claim 12, wherein the blower is configured to operate in a primary mode when the heater is in the activated state and in a recirculation mode when the heater is in the deactivated state.

14. The forced air conditioning system set forth in claim 13, wherein the controller is configured to send a recirculation command to the blower placing the blower in the recirculation mode when the preprogrammed temperature threshold is exceeded.

15. The forced air conditioning system set forth in claim 14, wherein the first, second, and third air dampers are air return dampers adapted to isolate the return air plenum from the respective first, second, and third rooms.

16. The forced air conditioning system set forth in claim 15, wherein the first, second, and third air return dampers are in a closed position if the air in the associated first, second, and third rooms exceed the preprogrammed temperature threshold, and are is an open position if the air in the associated first, second, and third rooms does not exceed the preprogrammed temperature threshold.

17. The forced air conditioning system set forth in claim 16, further comprising:

first, second, and third air supply dampers adapted to isolate the respective first, second, and third rooms from the supply air plenum, wherein the first, second, and third air supply dampers are in an open position if the air in the associated first, second, and third rooms exceed the preprogrammed temperature threshold, and at least one of the first, second, and third air supply dampers are in a closed position if the air in the associated first, second, and third rooms does not exceed the preprogrammed temperature threshold and when the heater is in the deactivated state.

18. The forced air conditioning system set forth in claim 17, wherein the preprogrammed temperature threshold may be an upper temperature threshold, and the controller further includes a preprogrammed lower temperature threshold, and wherein the first air supply damper is in the closed position, the second air supply damper is in the open position, the third air supply damper is in the closed position, the first air return damper is in the open position, the second air return damper is in the closed position, and the third air damper is in the closed position when the air temperature in the first room exceeds the upper temperature threshold, the air temperature in the second room is below the lower temperature threshold, and the air temperature in the third room is between the upper and lower temperature thresholds.

* * * * *